United States Patent [19]

Kilgore

[11] 4,186,442

[45] Feb. 5, 1980

[54] HAIRDRESSER'S HAND PROTECTOR

[76] Inventor: James W. Kilgore, P.O. Box 33626, Seattle, Wash. 98133

[21] Appl. No.: 26,533

[22] Filed: Apr. 3, 1979

[51] Int. Cl.[2] ..... A41D 13/00

[52] U.S. Cl. ..... 2/20

[58] Field of Search ..... 2/16, 20, 312, 314

[56] References Cited

U.S. PATENT DOCUMENTS

| | | | |
|---|---|---|---|
| 804,406 | 11/1905 | Hungad | 2/20 |
| 1,082,542 | 12/1913 | Manson | 2/20 |
| 3,238,939 | 3/1966 | Stubbs | 2/16 X |

*Primary Examiner*—Doris L. Troutman

*Attorney, Agent, or Firm*—Christensen, O'Connor, Johnson & Kindness

[57] ABSTRACT

A hand protector comprising a flexible pad with enlarged end portions and a narrow intermediate portion and with mutually divergent pairs of straps that connect the end portions to a wrist band to maintain the enlarged end portions overlying areas of the palm and backside of the hand with the intermediate portion stretched across the crotch between two fingers used in holding hair ends for trimming with scissors.

5 Claims, 3 Drawing Figures

HAIRDRESSER'S HAND PROTECTOR

BACKGROUND OF THE INVENTION

This invention relates to a hand protector for hairdressers; more particularly to a convenient and effective means to prevent snipping or puncturing the skin in the area of the crotch between the two fingers used to hold the hair ends when trimming the hair with sharp-tipped scissors in the customary manner. The invention is herein illustratively described by reference to the presently preferred embodiment thereof; however, it will be recognized that certain modifications and changes therein with respect to details may be made without departing from the essential features involved.

In trimming hair, it is a common technique to grasp the hairs with the ends allowed to protrude pinched together between the index and middle finger of one hand, cut off the protruding ends with sharp-tipped scissors held in the other hand and advanced towards the crotch of the two fingers holding the hair. This operation is conducted very quickly over and over again during the course of trimming the hair. Because of the necessity of doing the job quickly, even a careful operator can nick or snip the skin of the hand leading to discomfiture and sometimes infections. A broad object of this invention is to provide a hand protector which protects the hand against injury in this manner.

A related object hereof is to provide a hand protector which is of such lightweight compact form and so designed also in other respects as to avoid interference with the sensitive and dexterous use of the hand in properly grasping and holding the hair for trimming.

A further object of this invention is to provide a hairdresser's hand protector which is relatively inexpensive to manufacture and easily and quickly applied and removed at the proper stages in the overall hair dressing operation.

SUMMARY OF THE INVENTION

As herein disclosed, the improved hairdresser's hand protector comprises an elongated flexible pad having enlarged end portions and an intermediate relatively narrow portion interconnecting the end portions and adapted to fit in the crotch of the two fingers that are used to grasp the hair. The end portions are stretched over the backside and front or palm side of the hand, respectively, each by a pair of straps, preferably of elastic material, that diverge toward the wrist of the hand for securement to a wrist band. The wrist band and straps form a harness that maintains the pad stretched over the crotch of the two fingers used in hair trimming, with the enlarged end portions of the pad closely held overlying respective surface areas of the backside and palm side of the hand requiring protection along with the surface area in the crotch between such fingers.

These and other features, objects and advantages of the invention will become more fully evident from the following description with reference to the accompanying drawings.

DETAILED DESCRIPTION WITH REFERENCE TO ILLUSTRATED EMBODIMENT

Figure 1:
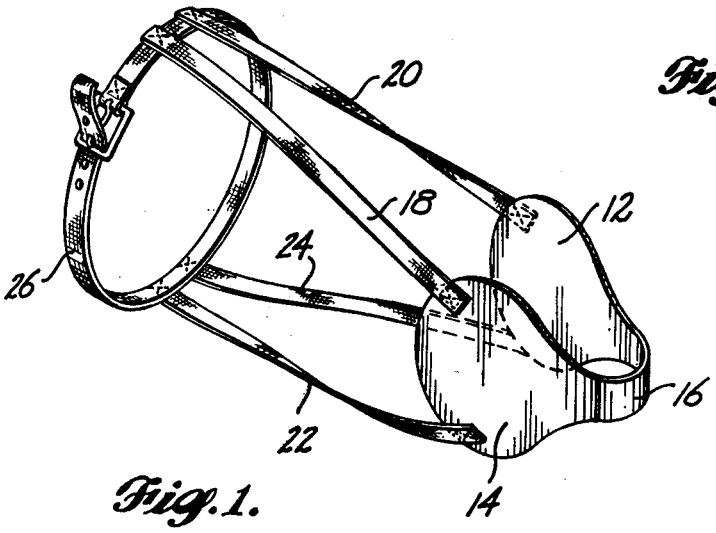
FIG. 1 is an isometric view of the improved protector with the wrist band closed.
Figure 3:
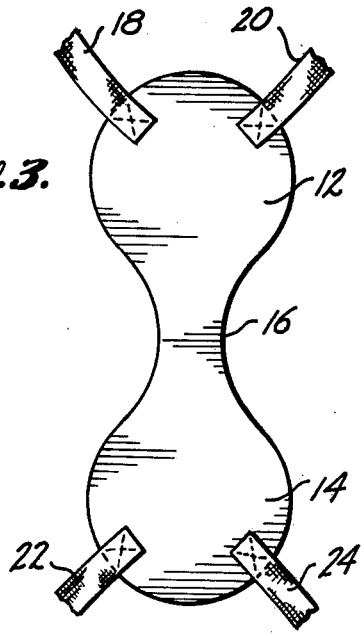
FIG. 3 is a face view of the protector pad shown flattened, with the end portions of straps attached in outwardly divergent relationships.
Figure 2:
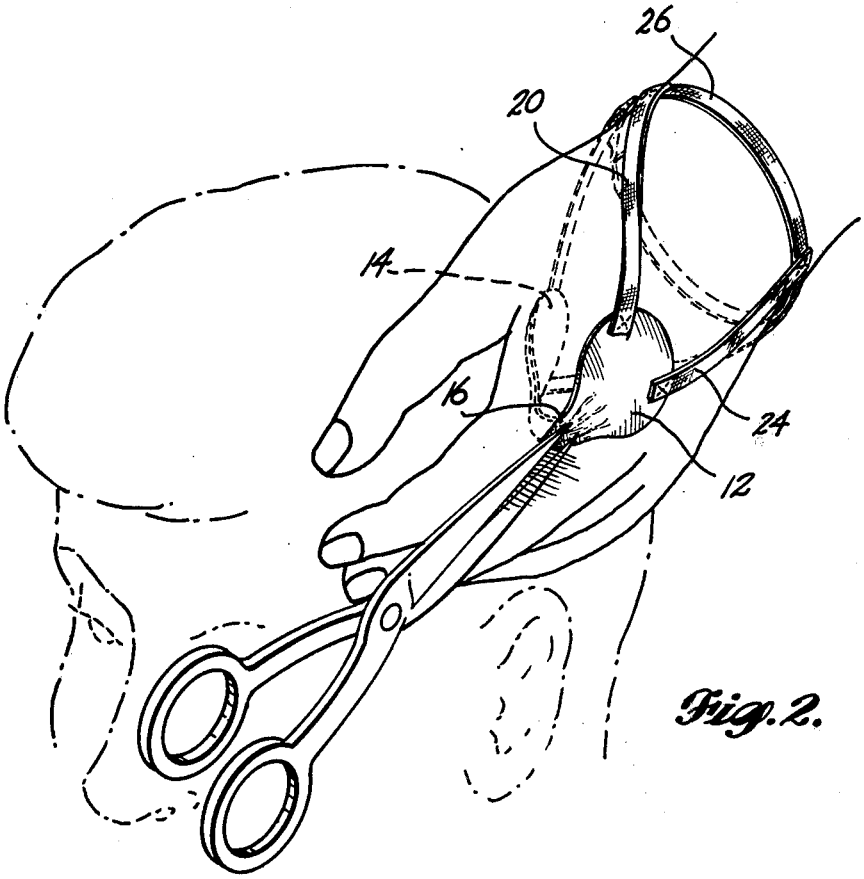
FIG. 2 is a perspective view illustrating use of the protector on the hairdresser's hand.

As illustrated, the novel hairdresser's hand protector comprises a flexible pad 10 preferably of thin supple top-grain leather having opposite end portions 12 and 14 of generally rounded configuration and a connecting intermediate portion 16 that is sufficiently narrow to be received comfortably in the crotch between the index finger and middle finger of the hand used to hold the customer's hair for purposes of trimming. For reasons of comfort and to conform to the rounded configuration of the fingers at the base where they join the palm and backside of the hand, the opposite side edges of the pad 10 where the base or end portions 12 and 14 converge into the intermediate portion 16, have smooth concave curvature, forming an hourglass shape effect so they can comfortably wrap around the convex curvature of the bases of the fingers. The rounded enlarged end portions 12 and 14 are preferably rounded at their outer end edges in order to avoid the presence of unnecessary flaps or projecting corners of material, although this configurational detail is not functionally critical.

The pad is held in place on the operator's hand by a harness arrangement which in the preferred embodiment comprises two pairs of tension elements or straps and a wrist band, one pair of straps to extend along the backside and one pair along the palm side of the hand when in place. Thus, a first pair of straps 18 and 20 are fastened to the outer extremity of end portion 12 at transversely spaced locations thereon whereas a second pair of straps 22 and 24 are similarly fastened to the opposite end portion 14 at transversely spaced locations. The straps of each pair diverge from the pad for securement at even more widely spaced points on the wrist band 26 adapted to encircle and be fastened around the wearer's wrist. The lengths of the straps 18, 20, 22 and 24 are approximately equal and are such as to maintain the pad 10 under slight tension drawn over the crotch of the fingers with the respective end portions 12 and 14 stretched flat over the palm and backside of the wearer's hand. When in place, the transversely spaced connecting points of the straps to the pad end portions and the divergence of the straps to maintain the pad end portions stretched not only lengthwise but also transversely so as to lie flat against the skin.

The wrist band 26 may be of any desired form, material and construction, but preferably comprises an elastic band with a snap, buckle or other means of attachment by which it may be conveniently slipped over the hand and upon the wrist or otherwise secured upon the wrist.

Preferably the harness straps 18, 20, 22 and 24 comprise woven or knitted elastic bands partly of rubber and partly of synthetic or natural non- elastic fibers that can maintain a slight tension in the straps and thereby in the pad in its installed position. As a matter of convenience and economic choice, the ends of the straps are preferably stitched or sewn to the pad and to the wrist band, although other means of attachment may be applied at either end of the straps.

The pad material itself may also vary although it is preferred to employ a thin and supple top grain leather which is at once soft and yet tough and durable as well as comfortable to the skin which it covers. Its thinness and supple qualities, together with the compact and form-fitting configuration of the pad designed to fit over the crotch and protectively cover the crotch as well as the immediately adjoining vulnerable injury areas of the palm and backside of the hand permits the wearer to perform with the usual dexterity and sensitivity to the task without encumberance by the presence of the protector. Since a minimum of material is involved and the parts are relatively few and easily fabricated, the cost of manufacturing the protector may be kept at a minimum while still utilizing top-grade materials compatible with the objectives of the invention.

Also, because of the conservation of material and the efficient configuration of the pad portion as well as the harness portion of the protector, the wearer's hand is not smothered in areas not requiring protection or coverage; hence, the wearing of the protector is not attended by discomfort due to perspiration or hairs trapped behind an unduly large pad. Should hair become lodged between the protector pad or straps and the hand, the operator can quickly flick the components of the protector, especially if the straps are elastic, in order to dislodge the hair and restore comfort.

These and other aspects of the invention will be evident to those skilled in the art based upon an understanding of the foregoing description of the presently preferred embodiment. It should be recognized that variations in detail are possible within the principles involved and that therefore the claims that follow should be interpreted in accordance with the spirit and purpose of the disclosure of the invention in its illustrated embodiment.

The embodiments of the invention in which an exclusive property or privilege is claimed are defined as follows:

1. A hairdresser's hand protector comprising an elongated flexible pad having opposite end portions adapted to cover respectively areas on the palm and back sides of the hand contiguous to the crotch of two mutually adjacent fingers and connected by an intermediate portion narrower in width than said end portions and adapted to fit in the crotch between said fingers with the end portions drawn toward the wrist, and harness means including a wrist band and tension element connecting said wrist band to said pad end portions at transversely spaced locations on the latter respectively on the palm and back sides of the hand so as to stretch out the end portions across and lengthwise of the hand.

2. The hand protector defined in claim 1 wherein the tension elements comprise two straps connected to each pad end portion and extending with angular divergence wristward therefrom.

3. The hand protector defined in claim 2 wherein the straps comprise elastic material.

4. The hand protector defined in claims 1, 2 or 3 wherein the pad comprises a single thin sheet of supple glove leather.

5. The hand protector defined in claims 1, 2 or 3 wherein the pad end portions taper into the intermediate portion with concave curvature on each side edge of the pad.

* * * * *